US006779217B2

(12) United States Patent
Fisher

(10) Patent No.: US 6,779,217 B2
(45) Date of Patent: Aug. 24, 2004

(54) APPENDAGE FOR A ROBOT

(75) Inventor: Charles William Fisher, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 464 days.

(21) Appl. No.: 09/785,356

(22) Filed: Feb. 16, 2001

(65) Prior Publication Data

US 2002/0002751 A1 Jan. 10, 2002

Related U.S. Application Data

(63) Continuation-in-part of application No. 09/580,083, filed on May 30, 2000, now Pat. No. 6,481,515.

(51) Int. Cl.[7] ..... A47L 11/292
(52) U.S. Cl. ..... 15/98; 15/49.1; 15/79.2
(58) Field of Search ..... 15/97.1, 98, 49.1, 15/39.5, 231, 78, 79.1, 79.2, 80–88

(56) References Cited

U.S. PATENT DOCUMENTS

| | | | | |
|---|---|---|---|---|
| 3,981,106 A | * | 9/1976 | Gallo | 451/490 |
| 4,114,711 A | | 9/1978 | Wilkins | |
| 5,012,886 A | | 5/1991 | Jonas et al. | |
| 5,279,672 A | | 1/1994 | Betker et al. | |
| 5,440,216 A | | 8/1995 | Kim | |
| 5,555,587 A | * | 9/1996 | Guha | 15/98 |
| 5,613,261 A | | 3/1997 | Kawakami et al. | |
| 5,720,077 A | | 2/1998 | Nakamura et al. | |
| 5,735,959 A | | 4/1998 | Kubo et al. | |
| 5,815,880 A | | 10/1998 | Nakanishi | |
| 5,870,791 A | * | 2/1999 | Gurstein et al. | 15/98 |
| 5,894,621 A | | 4/1999 | Kubo | |
| 5,903,124 A | | 5/1999 | Kawakami | |
| 5,915,437 A | | 6/1999 | Petner | |
| 6,098,239 A | | 8/2000 | Vosbikian | |
| 6,119,057 A | | 9/2000 | Kawagoe | |
| 2001/0004719 A1 | | 6/2001 | Sommer | |

FOREIGN PATENT DOCUMENTS

| | | |
|---|---|---|
| DE | 100 00 407 A | 7/2001 |
| EP | 0 424 229 A | 4/1991 |
| JP | 57 103616 A | 6/1982 |
| WO | WO 97/02075 | 1/1997 |

* cited by examiner

*Primary Examiner*—Randall E. Chin
*Assistant Examiner*—S. Balsis
(74) *Attorney, Agent, or Firm*—Larry L. Huston; Leonard W. Lewis; Steven W. Miller

(57) ABSTRACT

The present invention relates to a horizontally movable and downwardly biased appendage that extends laterally from a surface treating apparatus, such as a robotic floor cleaner.

The robotic floor cleaner and/or appendage may use disposable cleaning sheets, such as dust clothes, wipes, sheet-brushes, and the like, to clean under objects or into corners but does not substantially interfere with the rotation of the surface treating apparatus about its axis when it is adjacent to encountered obstacles. The appendage can extend under low hanging obstructions to remove dirt, and reach into corners innavigable or unreachable by the robotic floor cleaner.

12 Claims, 3 Drawing Sheets

APPENDAGE FOR A ROBOT

RELATED APPLICATION

This application is a continuation-in-part of application Ser. No. 09/580,083, filed on May 30, 2000 now U.S. Pat. No. 6,481,375 having the title "Autonomous Mobile Surface Treating Apparatus".

FIELD OF THE INVENTION

The present invention is directed to an appendage that extends laterally from a mobile surface treating apparatus or other robot. More specifically, the present invention relates to a horizontally movable and downwardly biased appendage that extends laterally from a surface treating apparatus, such as a robotic floor cleaner, and uses disposable cleaning sheets, such as dust clothes, wipes, sheet-brushes, and the like.

BACKGROUND OF THE INVENTION

In the home and elsewhere various appliances, furniture, and similar articles rest on the floor with legs or risers and are raised above the floor surface only a few inches. Similarly, appliances and counters may have low overhangs. Dust, pet hair, and other debris tend to collect under these objects and in hard to reach areas of the floor.

Due to the height and size of surface treatment apparatuses, such as floor cleaning robots, these devices generally are prevented from moving under such objects to clean this area of the floor. Also, some of these surface treatment apparatuses have design constraints, such as wheels designed high enough to roll over surface transitions, and thus are too tall to permit the robot to reach such areas of the floor.

In addition, it is advantageous for a mobile surface treating apparatus, which must navigate in unstructured environments such as a residence, to be able to change direction by rotation around a vertical axis. In order to effectively rotate in very tight spaces, the mobile surface treating apparatus must have a substantially upright cylindrical shape around a central vertical axis. However, the upright cylindrical shape has the disadvantage of not being able to reach into corners of rooms or into similarly sharply, angularly constrained floor spaces. Horizontally rigid extensions protruding beyond the right cylindrical shape of the robot to reach under such objects or into the corners of rooms are not desirable because they tend to prevent the apparatus from rotating due to the extension being blocked by these same objects.

Copending, commonly-owned U.S. patent application Ser. No. 09/580,083 filed by Kirkpatrick et al. on May 30, 2000, and incorporated herein by reference discloses flexible brushes that extend laterally from the robot. However, these brushes do not collect, i.e., remove dust and debris from the surface and carry it from these hard to reach areas of the surface. These brushes just sweep the dust into the path of the surface treating module for later collection and disposal. The surface treating module may miss the dust and debris due to the brushes not sweeping the dust into the path of the module.

A need exists for an appendage that laterally extends beyond the peripheral edge of the robot that will clean and collect the dust and debris from these hard to reach areas of the surface, such as under couches and counter top overhangs, and into corners of rooms, and yet, permit the robot to rotate around a vertical axis without the appendage preventing the rotation, or translation of the robot, due to the appendage being blocked by or hung up on an obstacle.

SUMMARY OF THE INVENTION

The present invention relates to a robot having a periphery. An appendage extends laterally outwardly beyond, and optionally from the periphery of the robot. The appendage reaches areas unreachable by the peripherally circumscribed portions of the robot. The appendage may optionally be downwardly biased and/or horizontally movable relative to the robot.

DETAILED DESCRIPTION OF THE INVENTION

Referring to FIGS. 1, 1A, 1B, and 2 the present invention relates to a horizontally movable and downwardly biased appendage for use with a mobile surface treating apparatus, such as a robot. The robot is suitable for a variety of surface treatments, an exemplary treatment of which is floor cleaning. In addition to floor cleaning, such surface treatments include, for example, treatments that provide "protective" benefits to floors and other surfaces, such as stain and soil protection, fire protection, UV protection, wear resistance, dust mite and insect control, anti-microbial treatment, and the like. Other examples of such surface treatments include, for example, treatments that provide "aesthetic" benefits to floors and other surfaces, such as buffing, odorization/deodorization; and applying polishes.

Figure 1:
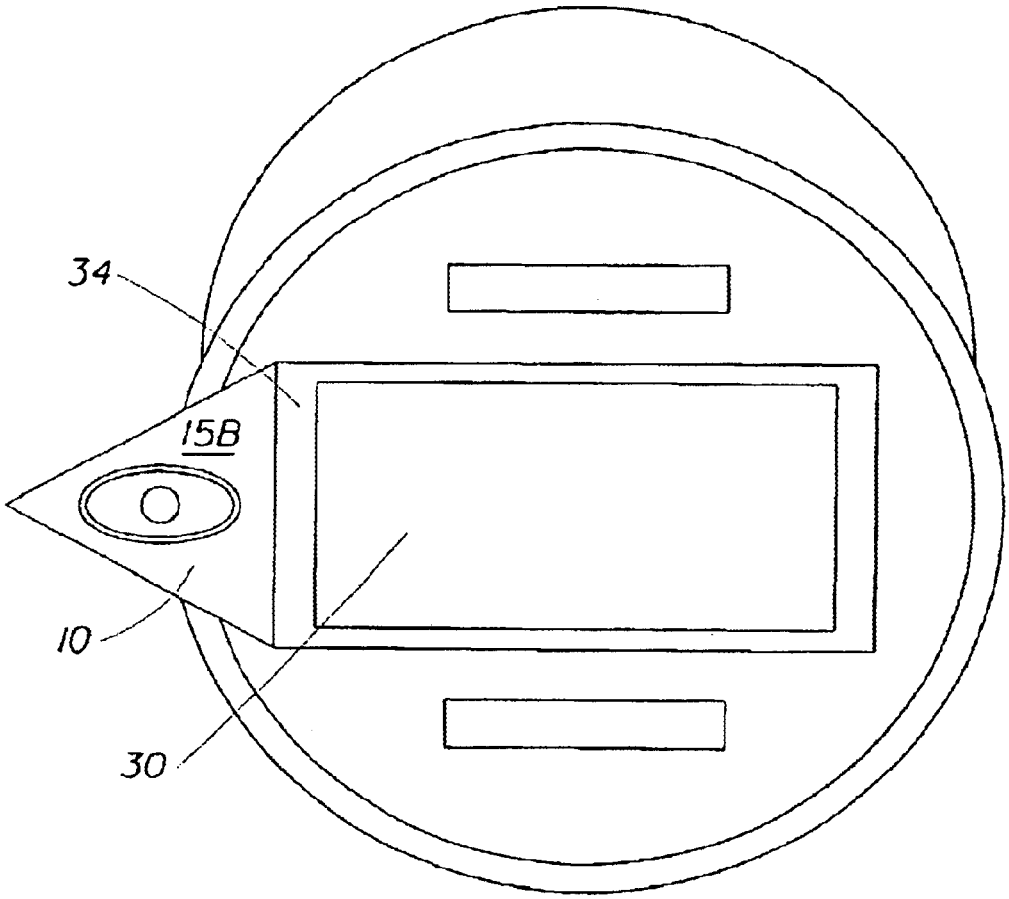
FIG. 1 is a bottom perspective view of a robot according to the present invention.
Figure 1A:
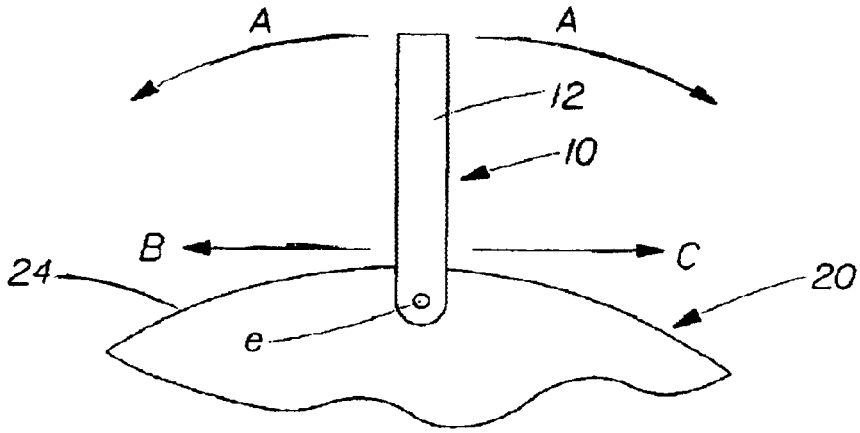
FIG. 1A is a fragmentary view of a robot having an articulably mounted appendage according to the present invention.

Referring to FIG. 1A, the appendage 10 of the present invention includes a body 12 that is movable in the horizontal plane and is downwardly biased toward the surface. Appendage 10 extends from a proximal end laterally beyond the peripheral edge 24 of the mobile surface treatment apparatus 20. Appendage 10 terminates in a distal end.

Appendage 10 may have a length from the proximal to the distal end of 5 to 50 and preferably 10 to 25 cm. Appendage 10 may have a width, taken parallel to the floor, of 0.25 to 20 cm. The length and width of the appendage 10 respectively define an aspect ratio. The appendage 10 may have an aspect ratio of at least 4 in one embodiment, and at least 10 in a second embodiment.

Appendage 10 can move in the horizontal plane in an articulated or pivotal motion A about a fixed point (e). The fixed point (e) is juxtaposed with or coincident the proximal end of appendage 10. Also or alternatively, appendage 10 can move in the horizontal plane in a translational motion (not shown) in either or preferably both of the lateral directions B and C. In this alternative example, surface treating apparatus 20 has appendage 10 translationally attached to the robot in order to permit appendage 10 to move in either or both lateral directions.

Figure 1B:
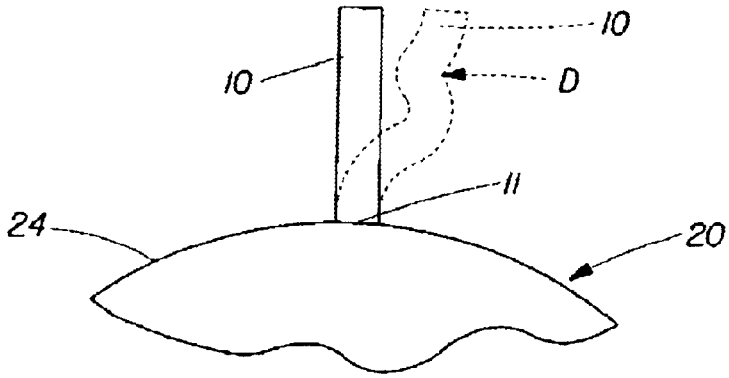
FIG. 1B is a fragmentary view of a robot having a flexible appendage according to the present invention.

Referring to FIG. 1B, appendage 10 can also move in the horizontal plane in a bending motion (D). This bending motion can be accomplished by making appendage 10 from a flexible material and fixedly attaching the proximal end 11 of appendage 10 to surface treating apparatus 20. The term, "flexible material", as used herein, includes all materials that exhibit either flaccid or resilient properties. The term, "flaccid", as used herein, refers to a material that will bend when a force is applied to it and will not bend back the opposite direction without an additional force being applied to it in the opposite direction, i.e., a material having no spring constant. Flaccid is the opposite of resilient. Non-limiting examples of flaccid material include a strand of cotton optionally encased in a sheath, flexible sheet goods, such as nonwovens, woven cloth and tissue, and even a common sock.

In contrast, the term, "resilient", as used herein, refers to a material that will naturally, or under the influence of an applied spring, move back towards the opposite direction when bent by an applied force without the need for an external restoring force, i.e., a material having a spring constant. A non-limiting example of a flexible material is a rubber material. Note, a resilient appendage 10 may not spring back the entire distance in the original direction due to hysteresis. Thus, when the surface treating apparatus rotates about its vertical axis, the apparatus swings the free end of the flexible appendage along the horizontal plane. In addition, the appendage's 10 horizontal movement can be motorized if desired, however, it is not necessary for the application of the present invention.

A flexible appendage 10 exhibits the advantage of simplicity of construction, random bending of the appendage may reach areas otherwise inaccessible and the flexibility may reduce the likelihood of the appendage inhibiting movement of the robot as obstructions are encountered. The random nature of the bending refers to the position, direction, and/or amount of the bending which occurs in the appendage 10.

Figure 1C:
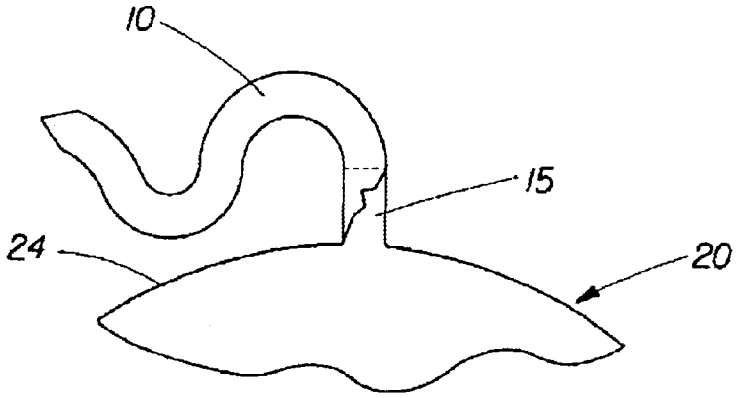
FIG. 1C is a fragmentary view of a robot having a flexible appendage according to the present invention, shown partially in cutaway to reveal an optional rigid stem.

Referring to FIG. 1C, if desired, the appendage may have a rigid stem 15 coincident the proximal end of the appendage 10. The rigid stem 15 extends a relatively short distance towards the distal end of the appendage 10. The balance of the flexible appendage 10 extends laterally outwardly beyond the rigid stem 15. The rigid stem 15 provides the benefit of assuring the flexible appendage 10 will laterally extend beyond the periphery of the robot and not interfere with its movement.

Figure 2:
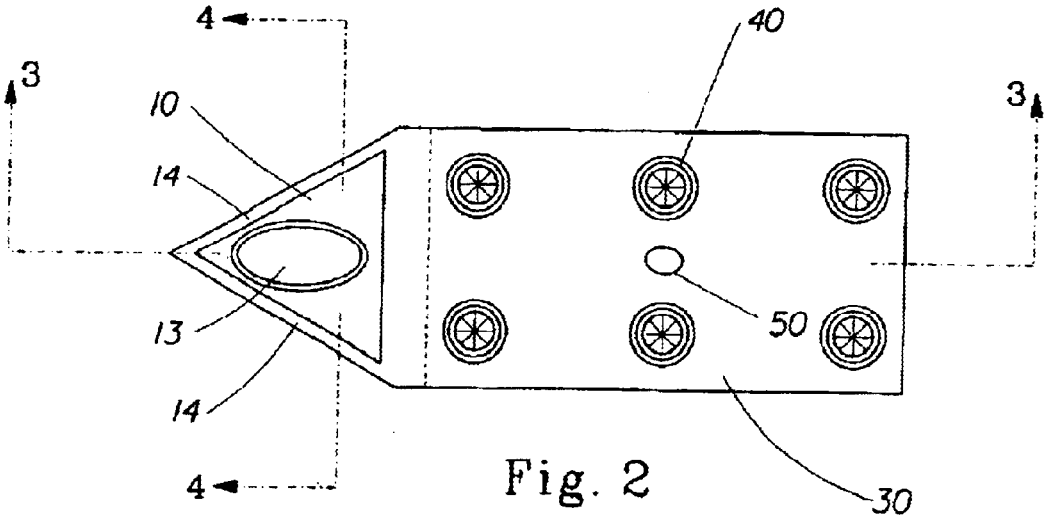
FIG. 2 is a bottom plan view of one exemplary robot according to the present invention.
Figure 3:
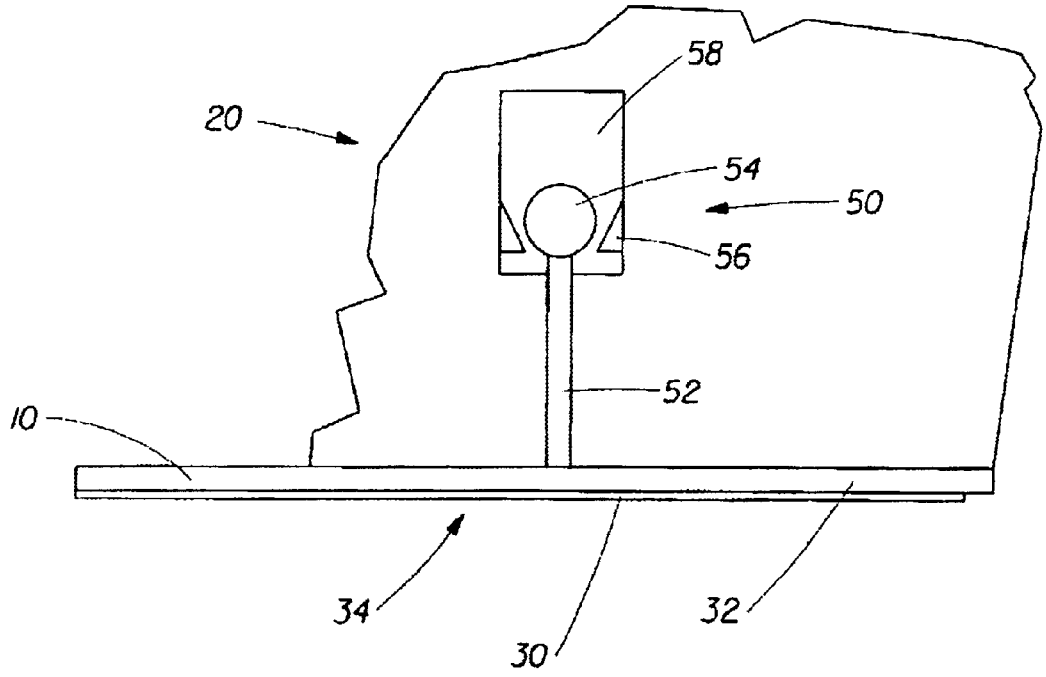
FIG. 3 is a sectional view taken along line 3—3 of FIG. 2.

FIGS. 2–3 show one embodiment of horizontally movable and downwardly biased appendage 10 for use with a mobile surface treating apparatus. In this particular embodiment, appendage 10 is integral with a sheet holder 34, in contrast to the aforementioned embodiments where the appendage 10 is not integral with the balance of the robot 20. Sheet holder 34 includes a rigid supporting element 32 having a first side and a second side, a plurality of sheet attachment positions 40, a compliant pad 30 attached to second side of said supporting element 32 and a sheet holder connector 50. Sheet holder connector 50 attaches supporting element 32 and appendage 10 to robot 20.

In this particular embodiment, appendage 10 may be made of a flexible material, preferably a resilient or elastic material such as rubber or cellular foam. In addition, sheet holder 34, rigid supporting element 32, compliant pad 30 or any combination thereof can also be made of a flexible material, preferably a resilient or elastic material such as rubber or cellular foam. However, it is preferable that rigid supporting element 32 is made of a more rigid material than the compliant pad 30, in order to provide more structural integrity to the sheet holder 34.

Figure 4:
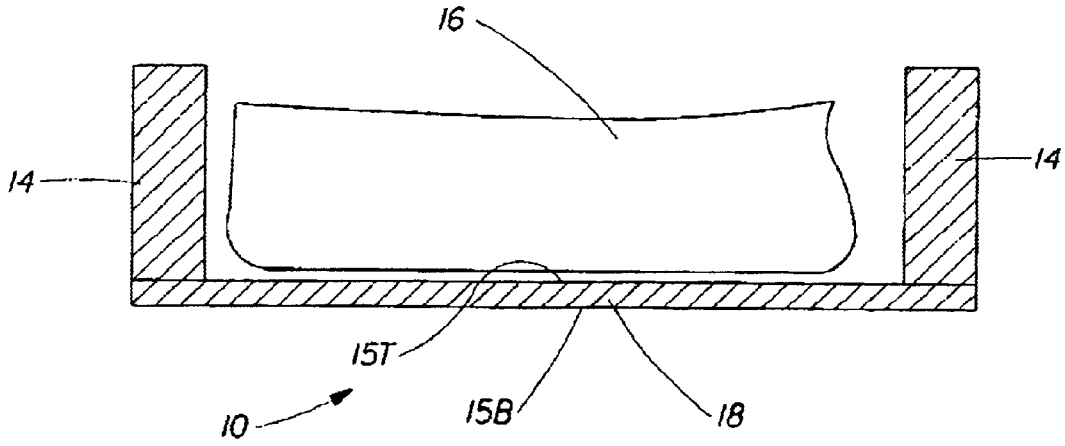
FIG. 4 is a cross sectional view of an appendage, taken along line 4—4 of FIG. 2.

Referring to FIG. 4, appendage 10 has a top surface 15T, a bottom surface 15B and includes at least one sheet holder receptacle 40. The sheet holder receptacle 40 engages the sheet, and is one of many available attachments for securing the sheet to the compliant pad 30. Adhesive, cohesive, frictional engagement, and mechanically interlocking attachment systems are known in the art and included within the scope of the present invention.

In the preferred embodiment, appendage 10 is downwardly biased via one or more stiffening, ribs 14 that extend upwardly from top surface 15T of appendage 10. Due to the section modulus, ribs 14 resists vertical motion more than the horizontal motion. In one particular embodiment, rib 14 is disposed along the peripheral edge of appendage 10, although a single rib 14 may be centered within, or offset from the center of the appendage 10. Generally, bottom surface 15B of appendage 10 is substantially uniform. However, an open structure comprised of vertical ribs can be employed with similar results without changing the scope of the invention.

Rib 14 may be separately formed from a previous lower membrane 18. A fluid containing reservoir 16 may be placed within appendage 10 to add weight to assist in the downwardly biasing of appendage 10 and/or dispense fluids through the lower membrane 18. In one particular embodiment, a vertically extending rib 14 is molded continuously as one piece with lower membrane 18 and reservoir 16 if a fluid bearing container is desired.

Other horizontally resilient, but vertically firm mechanisms may be used for appendage 10 such as a horizontally flaccid chain-like structure, including but not limited to similar to a bicycle chain, a mop-like structure having a horizontally resilient core and plural flaccid cords attached thereto or a furry tube-like tail formed around a central vertical rib providing a downward bias and horizontal resilience providing for an animalistic appearance.

It should be noted that although appendage 10 has been pictured as roughly triangular, its width, length, and form can be advantageously varied. For example, the rib structure may have an opening on one side, and be used with a robot that rotates so that the opening leads the sweep of the tail can be used to scoop up large particles. Alternatively, a long narrow tail can be used to reach further under large, low-lying furniture and appliances. The tail may be tapered as illustrated in FIG. 1C, to reduce occurrences of engaging obstructions during movement and provide more constant bending stress throughout its length, may be enlarged at the distal end to provide additional capability for gathering debris, may be forked or split into multiple distal ends.

Referring back to FIGS. 2–3, one particular embodiment of sheet holder 34 is a substantially rigid sheet holder shown in U. S. Design Pat. No. 409,343 issued to Kingry et al. and herein incorporated by reference. Sheet attachment receptacles are used to attach a cleaning sheet to compliant pad and/or to appendage 10 in such an embodiment. It is to be understood that appendage 10 may comprise materials which are disposable, i.e. discarded and not laundered or restored after use or materials which are suitable for cleaning and multiple uses.

Rigid sheet holders for manual or non-robotic use with disposable cleaning sheets are well known in the art as disclosed in U.S. Pat. No. 6,098,239 issued to Vosbikian and herein incorporated by reference. The Vosbikian patent describes a typical rigid sheet holder intended for manual, i.e., non-robotic, use equipped with storage compartments for attachable cleaning sheets. Sheet attachment receptacles 40 in the preferred embodiment consist of separated segments attached at the perimeter which are flexibly biased, such that by pushing a portion of cleaning sheet between the segments, the segments serve to hold and secure that portion of the sheet in place as described in the Vosbikian patent. It is contemplated that other devices may also be used to hold and maintain sheet on the sheet holder. For example, the resilient mop head clips disclosed in U.S. Pat. No. 5,915,437 or by micro hook means wherein the micro-hooks engage the cleaning cloth fabric such as the plastic micro hooks on a flexible backing sold under the Velcro® brand name by Velcro USA Inc., Manchester, N.H., or by a tacky or adhesive surface coating.

The removable cleaning sheets which may be disposable dusting cloths, damp wipes, flexible brushes, or the like are commonly attached to sheet holders. One particular embodiment of both sheet holders 34, sheet attachment receptacles 40 and the cleaning sheets are commercially available from Procter & Gamble Company. Cincinnati, Ohio sold under the Swiffer ® brand name.

FIG. 3 shows a particular embodiment of sheet holder 34. Sheet holder 34 may include a compliant pad 30 attached to the second side of sheet holder 34. A sheet holder connector 50 is attached to sheet holder 34. In this particular embodiment, sheet holder 34, connector 50 includes a sheet holder connector rod 52, i.e., a male rod, affixed to sheet holder 34, a spherical rod end 54 inserted in a female channel 58 mounted in the surface treating apparatus (not shown). Also, compliant elastic elements 56 may be affixed to the interior of the female channel 58. When spherical rod end 54 is inserted into the female channel 58, it displaces the compliant elastic elements 56, which serve to retain the spherical rod end 54 in the female channel 58. Sheet holder 34 is conversely detached by pulling it away from surface treating apparatus 20. It should be noted that many other attachment means known in the mechanical art may be used in lieu of a ball and socket type attachment including, but not limited to, magnets, a male extension of the robot fitting into a female channel in the sheet holder, or a threaded socket and rod. An alternative example of sheet holder connector 50 includes spherical rod end 54 on a distal end of the male rod 52, wherein spherical rod end 54 includes a permanent magnet. The surface treating apparatus 20 has a socket-mounted member 58 including a second magnet or ferromagnetic material located on its bottom side 24.

The sheet holder 34 is used by folding a cleaning sheet, sufficiently long, to cover the entire sheet holder over rigid supporting element 32 sheet holder 34 and securing the folded side ends of the sheet over and into sheet attachment receptacles 40. The longitudinal remainder of the sheet is folded around appendage 10 and the folded side ends of the sheet secured into sheet attachment receptacle 40, thereby covering bottom surface 15 of appendage 10. Sheet holder 34 is then attached to surface treatment apparatus 10 by plugging the male sheet holder attachment 50 into the bottom of surface treatment apparatus 10. Surface treatment apparatus 10 is placed on the surface to be treated such as a hard surface floor and propels the cleaning sheet in contact with the floor. When the robot reaches an overhanging obstacle or a corner and rotates about its vertical axis, the portion of the cleaning sheet overhanging appendage 10 sweeps and is projected outward with a downwardly bias from under surface treatment apparatus 10 by appendage 10 collecting and removing dirt and dust in corners and under overhanging obstacles where the surface treatment apparatus 10 will not fit. Appendage 10, while downwardly biased, is resilient horizontally so that it is pushed aside horizontally by contact with walls and other obstacles in contact with the floor.

It should also be noted that in the event that the cleaning mechanism which is to be used requires dispensing a cleaning fluid, polish, or other surface cleaning or maintenance fluid, such fluids can be dispensed into or through the appendage 10 by having a resilient fluid container mounted in the appendage 10, or by having flexible fluid conduits from a fluid container located externally to the appendage 10 so that a fluid can be dispensed onto the top of, or though, an attached absorbent or scouring cleaning sheet.

The robot 20 may comprise a surface treatment apparatus 20 such a mop, including a handle and mop head such as the Swiffer® brand mops marketed by Procter & Gamble. Appendage 10 is attached to the mop head. Surface treatment apparatus 20 can be mobile but controlled remotely either via a human, manually moved, as in the case of a mop or moved by some form of autonomous control. In the preferred embodiment, surface treatment apparatus 20 is an autonomous, mobile robot including generally, a chassis, a drive mechanism such as motor controlled wheels located on the chassis, a substantially rigid shell movable attached to the chassis, contact sensors which allow the robot to rotate and drive off in another direction when it runs into an obstacle and optionally some sensors such as infrared sensors to alert the robot of a pending collision. Such a device is describe in copending, common owned U.S. patent application Ser. No. 09/580,083 filed by Kirkpatrick et al. on May 30, 2000 and herein incorporated by reference.

While the embodiments have been illustrated with a single appendage 10, a plurality of appendages 10 may be used with a single robot 20. The plurality of appendages 10 may be equally or unequally circumferentially spaced from one another. Likewise the plurality of appendages 10 may be of equal or unequal length and have equivalent or different design features.

Although particular versions and embodiments of the present invention have been shown and described, various modifications can be made to the robot, sheet holder and appendage without departing from the teachings of the present invention.

What is claimed is:

1. An appendage that laterally extends from a mobile apparatus for treating a surface, said appendage comprising an elongate flaccid body having a proximal end which remains in fixed relationship relative to said mobile apparatus and a distal end remote therefrom, said body being transitionally movable in the horizontal plane whereby said distal end moves relative to said mobile apparatus and biased downwardly toward the treatment surface causing said body to contact the treatment surface and to collect dust and debris from the treatment surface.

2. An appendage according to claim 1, wherein said body is made of a flexible material.

3. An appendage according to claim 2, wherein said body having a length less than about 15.5 cm.

4. An appendage according to claim 1, wherein said appendage being pivotally attached to said mobile apparatus.

5. An appendage according to claim 1, wherein said first side having a rim disposed along a peripheral edge of said body, said rim extending upwardly from said first side, whereby said rim providing the downwardly bias of said body.

6. An appendage according to claim 1, wherein said appendage having an aspect ratio of at least 4.

7. An appendage that laterally extends from a mobile apparatus for treating a surface, said appendage comprising an elongate body having a proximal end which remains in fixed relationship relative to said mobile apparatus and a distal end remote therefrom including a top face and a bottom face, said body being movable in the horizontal plane whereby said distal end moves relative to the mobile apparatus and biased downwardly toward the surface;

at least one sheet holder connector attached to said top face of said body;

a compliant pad attached to said bottom face of said body; and a cleaning sheet, whereby said downwardly biased body causing said sheet to come in compliant contact with the surface and collect dust and debris from the surface.

8. An appendage according to claim 7, wherein said top face of said body comprises a rim disposed along a peripheral edge of said body, said rim extending upwardly from said top face, whereby said rim providing the downwardly bias of said body.

9. An appendage according to claim 8, wherein said body is made of a flexible material.

10. An appendage according to claim 8, wherein said appendage being pivotally attached to said apparatus.

11. An appendage according to claim 8, wherein said body is telescoping.

12. An appendage according to claim 8, wherein said body of said appendage is integral to a sheet holder body located under the mobile apparatus.

* * * * *